US006748789B2

(12) United States Patent
Turner et al.

(10) Patent No.: US 6,748,789 B2
(45) Date of Patent: Jun. 15, 2004

(54) REFORMED CAN END FOR A CONTAINER AND METHOD FOR PRODUCING SAME

(75) Inventors: Timothy Turner, Pecatonica, IL (US); Randy G. Forrest, Park Ridge, IL (US); Rajesh Gopalaswamy, Lake Zurich, IL (US)

(73) Assignee: Rexam Beverage Can Company, Chicago, IL (US)

( * ) Notice: Subject to any disclaimer, the term of this patent is extended or adjusted under 35 U.S.C. 154(b) by 127 days.

(21) Appl. No.: 10/041,827

(22) Filed: Oct. 19, 2001

(65) Prior Publication Data

US 2003/0075544 A1 Apr. 24, 2003

(51) Int. Cl.[7] ..... B21D 51/44
(52) U.S. Cl. ..... 72/379.4; 413/8
(58) Field of Search ..... 72/348, 379.4; 413/8

(56) References Cited

U.S. PATENT DOCUMENTS

| | | | |
|---|---|---|---|
| 3,537,291 | A | 11/1970 | Hawkins |
| 3,774,801 | A | 11/1973 | Gedde |
| 3,843,014 | A | 10/1974 | Cospen et al. |
| 4,031,837 | A | 6/1977 | Jordan |
| 4,084,721 | A | 4/1978 | Perry |
| 4,093,102 | A | 6/1978 | Kraska |
| 4,109,599 | A | 8/1978 | Schultz |
| 4,217,843 | A | 8/1980 | Kraska |
| 4,372,720 | A | 2/1983 | Herdzina et al. |
| 4,434,641 | A | 3/1984 | Nguyen |
| 4,448,322 | A | 5/1984 | Kraska |
| 4,467,933 | A | 8/1984 | Wilkinson et al. |
| 4,559,801 | A | 12/1985 | Smith et al. |
| 4,561,280 | A | 12/1985 | Bachmann et al. |
| 4,567,746 | A | 2/1986 | Bachmann et al. |
| 4,571,978 | A | 2/1986 | Taube et al. |
| 4,577,774 | A | 3/1986 | Nguyen |
| 4,587,825 | A | 5/1986 | Bulso, Jr. et al. |

(List continued on next page.)

FOREIGN PATENT DOCUMENTS

| | | |
|---|---|---|
| EP | 0 103 074 A2 | 3/1984 |
| EP | 0 149 185 A2 | 7/1985 |
| EP | 0 149 823 A3 | 7/1985 |
| EP | 0 153 115 A 2 | 8/1985 |
| EP | 0 497 346 A1 | 8/1992 |
| EP | 0 497 346 B1 | 9/1996 |
| EP | 0 828 663 B 1 | 12/1999 |
| GB | 2 067 159 A | 7/1981 |
| GB | 1604068 | 12/1981 |
| GB | 2 193 140 A | 2/1988 |
| JP | 49-96887 | 9/1974 |
| JP | 2-131931 | 11/1990 |
| JP | 3-275443 | 12/1991 |
| JP | 192840 | 7/1996 |
| WO | WO 96/37414 | 11/1996 |
| WO | WO 98/34743 | 8/1998 |
| WO | WO 01/41948 A2 | 6/2001 |

*Primary Examiner*—Lowell A. Larson
(74) *Attorney, Agent, or Firm*—Wallenstein, Wagner & Rockey, Ltd.

(57) ABSTRACT

A method for strengthening an end member for a container comprises the steps of providing an end member shell and reforming the end member shell. The finished the end member has a central panel wall with a product side and a public side. The public side has a means for opening a frangible panel segment. The end member shell has a central panel extending radially outwardly from a central axis, a panel radius along a peripheral edge of the central panel, a countersink integral with the panel radius, a chuckwall extending upwardly from the countersink having a bend with a radius of curvature and angled axially outwardly, and a seaming curl defining the outer perimeter of the end member shell and integral with the chuckwall. The chuckwall of the end member shell is reformed to decrease the radius of curvature of the bend.

19 Claims, 2 Drawing Sheets

U.S. PATENT DOCUMENTS

| | | | | | |
|---|---|---|---|---|---|
| 4,606,472 | A | | 8/1986 | Taube et al. | |
| 4,641,761 | A | | 2/1987 | Smith et al. | |
| 4,648,528 | A | | 3/1987 | LaBarge et al. | |
| 4,685,849 | A | | 8/1987 | LaBarge et al. | |
| 4,704,887 | A | | 11/1987 | Bachmann et al. | |
| 4,713,958 | A | | 12/1987 | Bulso, Jr. et al. | |
| 4,716,755 | A | | 1/1988 | Bulso, Jr. et al. | |
| 4,722,215 | A | | 2/1988 | Taube et al. | |
| 4,735,863 | A | | 4/1988 | Bachmann et al. | |
| 4,790,705 | A | | 12/1988 | Wilkinson et al. | |
| 4,796,772 | A | | 1/1989 | Nguyen | |
| 4,808,052 | A | | 2/1989 | Bulso, Jr. et al. | |
| 4,809,861 | A | | 3/1989 | Wilkinson et al. | |
| 4,832,223 | A | | 5/1989 | Kalenak et al. | |
| 4,862,722 | A | | 9/1989 | Fraze et al. | |
| 4,865,506 | A | | 9/1989 | Kaminski | |
| RE33,217 | E | | 5/1990 | Nguyen | |
| 4,928,844 | A | | 5/1990 | LaBarge | |
| 4,977,772 | A | | 12/1990 | Bulso, Jr. et al. | |
| 4,991,735 | A | | 2/1991 | Biondich | |
| 5,046,637 | A | * | 9/1991 | Kysh | 72/348 |
| 5,062,287 | A | | 11/1991 | Brown et al. | |
| 5,149,238 | A | | 9/1992 | McEldowney et al. | |
| 5,331,836 | A | | 7/1994 | Cudzik | |
| 5,356,256 | A | | 10/1994 | Turner et al. | |
| 5,502,995 | A | * | 4/1996 | Stodd | 72/348 |
| 6,065,634 | A | | 5/2000 | Brifcani et al. | |
| 6,126,034 | A | | 10/2000 | Borden et al. | |
| 6,419,110 | B1 | | 7/2002 | Stodd | |
| 6,499,622 | B1 | | 12/2002 | Neiner | |

* cited by examiner

REFORMED CAN END FOR A CONTAINER AND METHOD FOR PRODUCING SAME

TECHNICAL FIELD

The present invention relates to end closures for two-piece beer and beverage metal containers having a non-detachable operating panel. More specifically, the present invention relates to improved reforming techniques to produce a lightweight end closure.

BACKGROUND OF THE INVENTION

Common end closures for beer and beverage containers have a central panel that has a frangible panel (sometimes called a "tear panel," "opening panel," or "pour panel") defined by a score formed on the outer surface, the "consumer side," of the end closure. Popular "ecology" can ends are designed to provide a way of opening the end by fracturing the scored metal of the panel, while not allowing separation of any parts of the end. For example, the most common such beverage container end has a tear panel that is retained to the end by a non-scored hinge region joining the tear panel to the reminder of the end, with a rivet to attach a leverage tab provided for opening the tear panel. This type of container end, typically called a "stay-on-tab" ("SOT") end has a tear panel that is defined by an incomplete circular-shaped score, with the non-scored segment serving as the retaining fragment of metal at the hinge-line of the displacement of the tear panel.

The container is typically a drawn and ironed metal can, usually constructed from a thin plate of aluminum. End closures for such containers are also typically constructed from a cut-edge of thin plate of aluminum or steel, formed into a blank end, and manufactured into a finished end by a process often referred to as end conversion. These ends are formed in the process of first forming a cut-edge of thin metal, forming a blank end from the cut-edge, and converting the blank into an end closure which may be seamed onto a container. Although not presently a popular alternative, such containers and/or ends may be constructed of plastic material, with similar construction of non-detachable parts provided for openability.

These types of "stay-on-tab" ecology container ends have been used for many years, with a retained tab and a tear panel of various different shapes and sizes. Throughout the use of such ends, manufacturers have sought to save the expense of the metal by down-gauging the metal of the ends and the tabs. However, because ends are used for containers with pressurized contents and are sometimes subject to pasteurization, there are conditions causing great stresses to the components of the end during pasteurization, transit and during opening by a user. These conditions limit the available gauge reduction of the end metal, and make it difficult to alter design characteristics of the end, such as by reducing metal gauge or the thickness of the metal residual in the score defining the tear panel.

The pressurized contents of the container often causes risk for the end to buckle. The pressurized contents may also result in a condition in which the tab is forced upwardly. There is a maximum allowable distance that the tab can be displaced without the tab extending upwardly above the remainder of the container. This is called tab-over-chime. Tab-over-chime leads to ship abuse problems wherein the frangible panel prematurely fractures during distribution of filled beverage containers.

As manufacturers reduce the thickness of the metal used to make the ends, buckle and tab-over-chime become more and more of a problem. Therefore, a need for can end with improved ability to withstand buckle and tab-over-chime is needed.

SUMMARY OF THE INVENTION

It is an object to provide a method for strengthening an end member for a container. The end member has a central panel wall with a product side and a public side. The public side has a means for opening a frangible panel segment. The method comprises the steps of providing an end member shell and reforming a portion of the end member shell.

The end member shell comprises a central panel which extends radially outwardly from a central axis. A panel radius is located along a peripheral edge of the central panel. A countersink is integral with the panel radius, and a chuckwall extends upwardly from the countersink and has a bend with a radius of curvature which angles the chuckwall axially outwardly. A seaming curl defines the outer perimeter of the end member shell and is integral with the chuckwall.

The reforming step is provided to reform the bend of the chuckwall to decrease the radius of curvature.

Another object of the present invention is to provide an end member for a container. The end member comprises a central panel, a first panel radius, a countersink, a chuckwall, and a seaming curl.

The central panel extends radially outwardly from a central axis. The panel radius is located along a peripheral edge of the central panel and includes a radius of curvature joining the central panel with the countersink. The countersink is integral with the first panel radius and joins the first panel radius with the chuckwall through an annular concave segment. The chuckwall extends upwardly from the countersink to a seaming curl located at an outer perimeter of the end member.

The end member further comprises an approach point. The approach point is defined by a lower outer position of an axially stacked second end member. This lower outer position is generally the lower extent of the countersink. A bend located on the chuckwall having an outwardly directed angle with a radius of curvature adapted to position the chuckwall radially outwardly of the approach point.

Other features and advantages of the invention will be apparent from the following specification taken in conjunction with the following drawings.

DETAILED DESCRIPTION

Figure 1:
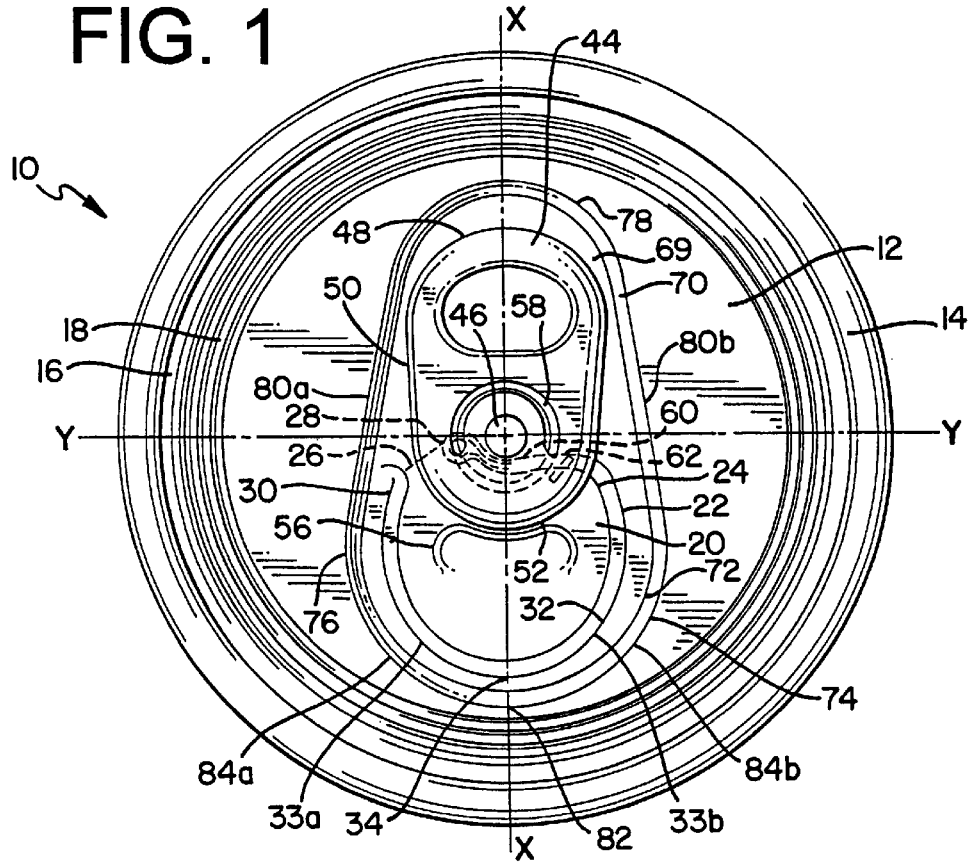
FIG. 1 is a top view of the can end of FIG. 1 with a tab staked thereto.

While this invention is susceptible of embodiment in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

The container end of the present invention is a stay-on-tab end member 10 with improved physical properties including strength. Essentially, the present invention provides a lightweight end member 10 which embodies the physical characteristics and properties required in the beverage container market, as explained below.

Referring to FIG. 1, the end member 10 for a container (not shown) has a central panel wall 12 having a seaming curl 14 for joining the wall to the container. The container is typically a drawn and ironed metal can, usually constructed from a thin plate of aluminum or steel, such as the common beer and beverage containers. End closures for such containers are also typically constructed from a cut edge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating curl of the container. The seaming curl 14 of the end closure 10 is interconnected to the central panel 12 by a chuckwall 15 and a countersink area 16 which is joined to the center panel 12 outer peripheral edge 18 of the central panel 12. This type of means for joining the central panel 12 to a container is presently the typical means for joining used in the industry, and the structure described above is formed in the process of forming the blank end from a cut edge of metal plate, prior to the end conversion process. However, other means for joining the central panel 12 to a container may be employed with the present invention.

The outer peripheral edge 18 of the central panel 12 is typically coined to add strength to can end 10. Coining is the work hardening of metal between tools. The metal is typically compressed between a pair of tools, generally an upper and lower tool.

The central panel wall 12 has a displaceable tear panel 20 defined by a curvilinear frangible score 22 with an adjacent anti-fracture score 24 on the tear panel 20, and a non-frangible hinge segment 26. The hinge segment 26 is defined by a generally straight line between a first end 28 and a second end 30 of the frangible score 22. The tear panel 20 of the central panel 12 may be opened, that is the frangible score 22 may be severed and the tear panel 20 displaced at an angular orientation relative to the remaining portion of the central panel 12, while the tear panel 20 remains hingedly connected to the central panel 12 through the hinge segment 26. In this opening operation, the tear panel 20 is displaced at an angular deflection, as it is opened by being displaced away from the plane of the panel 12.

The frangible score 22 and the second groove or anti-fracture score 24 are formed using conventional-type of scoring operation during the can end forming process, using tools including an upper (public side) die with a score knife and a lower (product side) die with an anvil surface.

The end member 10 also has a tab 44 secured to the center panel 12 by a rivet 46. The tab 44 has a lift end 48, a central region 50, and a nose portion 52. The lift end 48 and the nose portion 52 are generally aligned along a central longitudinal axis passing through the rivet 46. The rivet 46 is formed in the typical manner.

The user initiates opening of the end member 10 by lifting the lift end 48 of the tab 44. This lifts the rivet 46 which causes the score groove 22 to fracture in a vent region 60 which is located at least partially within the bounds of the coined region surrounding the rivet 46. As the nose portion 52 presses against the tear panel 20, the fracture of the score 22 propagates around the tear panel 20, preferably in progression from the first end 28 of the score 22 toward the second end 30 of the score 22.

The frangible score 22 includes a length defined by a thickened portion of the residual. This length is often referred to as a check slot region 62. The check slot 62 causes the propagation of the fracture of the frangible score 22 to slow naturally as the fracture reaches the check slot region 62. This allows the container to vent safely before the fracture of the frangible score 22 continues.

A deboss panel 69 is formed in the public side 34 of the central panel 12. The deboss panel 69 is formed in the central panel 12 using conventional die-forming techniques. The deboss panel 69 has a substantially gibbous-shaped deboss profile 70 which is, in turn, defined by an inner radius line 72 and an outer radius line 74. The deboss panel 69 may have bilateral symmetry with respect to a plane defined by axes X—X and Y—Y.

The deboss profile 70 includes first and second opposing end portions 76, 78 joined by a pair of sidewalls 80*a*, 80*b*. The first end portion 76 includes an apex 82. The apex 82 is joined to the sidewalls 80*a*, 80*b* by first and second arcuate portions 84*a*, 84*b*. The apex 82 lies between the transition region 34 of the frangible score 22 and the outer peripheral edge 18 of the center panel 12.

According to another aspect of the invention, a method for reforming a can end shell to produce the end member 10 described herein is disclosed. The method is used to produce a lightweight end member 10, for example from an 0.0080 inch thick aluminum stock for attachment to a container necked to a 202 (2.125 inches) open end. End members 10 of the present invention are generally manufactured using a multi-stage reforming method.

Figure 2:
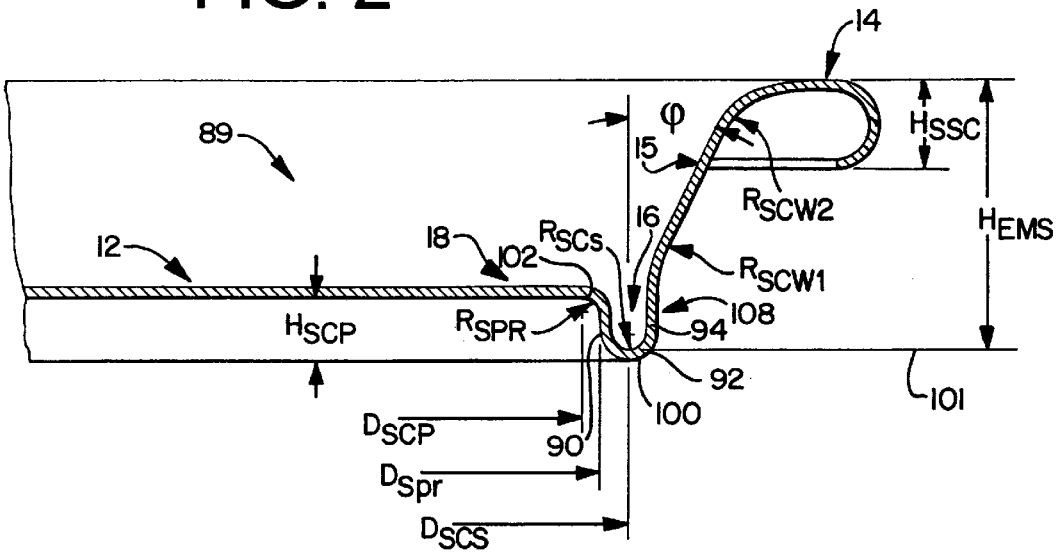
FIG. 2 is a partial cross-sectional view of end member shell prior to reforming.

Referring to FIG. 2, an end member shell 89 from a shell press and prior to reforming in a conversion press is illustrated. The shell center panel diameter is a distance designated $D_{SCP}$ from a central axis which is located at the intersection of the Y—Y and X—X axes (see FIG. 1). The countersink 16 of the end member shell 89 includes an inner wall 90, a curved segment 92, and an outer wall 94 and is a distance $D_{SCS}$ from the central axis. The curved segment 92 has a radius of curvature $R_{SCS}$ and includes an annular base 100 positioned along a horizontal plane containing a baseline 101. The center panel 12 is a height $H_{SCP}$ above the baseline, generally about 0.058 inches. The inner wall 90 is joined to a shell panel radius 102 along the outer peripheral edge portion 18 of the central panel 12. The shell panel radius 102 is located at a distance $D_{SPR}$ from the central axis and has a radius of curvature $R_{SPR}$. The outer wall 94 of the countersink 16 is joined to the chuckwall 15.

The chuckwall 15 includes a crease or bend portion 108 creating an angle $\phi$ of approximately 24°–28°, more preferably between 25°–26°, and most preferably about 25° 58', or any range or combination of ranges therein. The angle $\phi$ is directed outwardly of the central panel 12. The crease 108 has a radius of curvature $R_{SCW1}$ between 0.100 and 0.200 inches, preferably between 0.130 to 0.170 inches, more preferably about 0.150 inches, or any range or combination of ranges therein. The chuckwall 15 includes a second crease or bend having a radius of curvature $R_{SCW2}$ of about 0.070 inches.

The seaming curl 14 is located at an outer perimeter of the end member shell 89 at a height $H_{EMS}$ above the baseline 101 and has a shell seaming curl height $H_{SSC}$ which is measured from a lower extent of the seaming curl 14 to an upper extent of the seaming curl 14.

The end member shell 89 undergoes a reforming operation during which the center panel 12, the shell panel radius 102, the countersink 16, and the chuckwall 15 are reformed.

Figure 3:
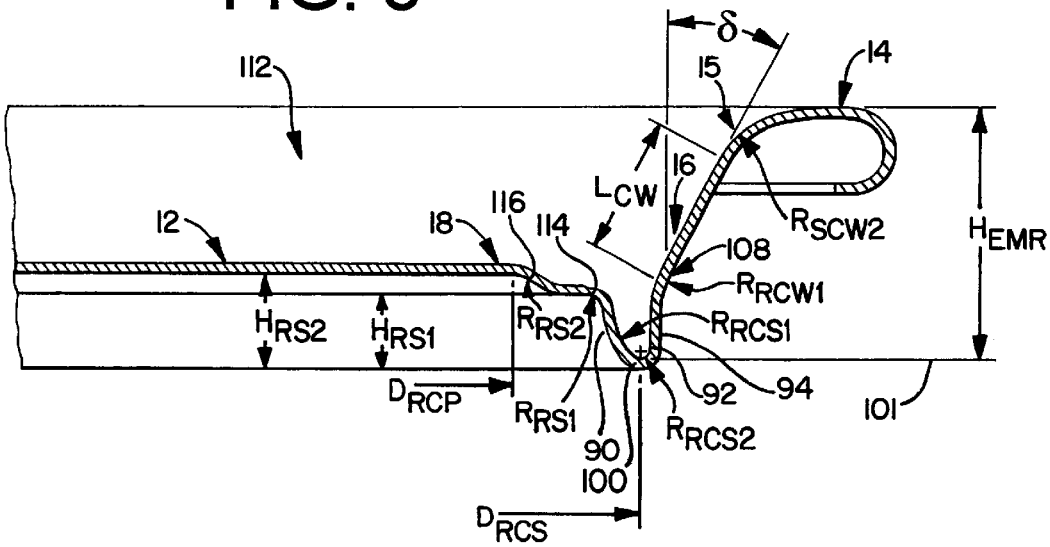
FIG. 3 is a partial cross-sectional view of a reformed end member.

FIG. 3 illustrates the shell member after reforming in a conversion press.

The reformed end member 112 includes a stepped profile along the outer peripheral portion 18 of the center panel 12. The stepped profile includes a first panel radius 114 interconnected to a second panel radius 116. A portion of the first panel radius 114 is coined. The first panel radius 114 is joined to the inner wall 90 of the countersink 16 and has a height $H_{RS1}$ which is approximately 0.070 inches above the baseline 101 and a radius of curvature $R_{RS1}$. The second panel radius 116 is joined to outer peripheral portion 18 of the center panel 12 and has a radius of curvature $R_{RS2}$ and a height $H_{RS2}$ which is approximately 0.088 inches above the baseline 101.

The dimensions of the first panel radius 114, the second panel radius 116, and the crease portion 108 are selected to optimize resistance to buckle. Buckle is the loss or degradation of ability of the pour panel 20 to withstand internal pressure.

Further to the reforming operation, the chuckwall 15 is reformed. In particular, prior to reforming, the crease 108 radius of curvature $R_{SCW1}$ is approximately 0.150 inches. Subsequent to reforming, the reformed end member 111 has a crease 108 radius of curvature $R_{RCW1}$ of 0.010–0.080 inches, more preferably between 0.015–0.025 inches, and most preferably 0.020 inches, or any range or combination of ranges therein. The reforming also increases the distance $L_{CW}$ between first and second radii of curvature $R_{RCW1}$ and $R_{RCW2}$ from approximately 0.108 to 0.125. The second radius of curvature RRCW2 is substantially unchanged during the reforming operation. This reforming of the chuckwall 15 increases the chuckwall angle $\phi$ creating a new chuckwall angle $\delta$ of about 24°–28°, more preferably between 25°–26°, and most preferably 26°, or any range or combination of ranges therein.

The reforming also creates a compound radius structure in the countersink 16. Prior to reforming, the countersink 16 includes the annular base 100 having a radius of curvature $R_{SCS}$. Subsequent to the reforming operation, the countersink 16 has an inner radius of curvature $R_{RCS1}$ and an outer radius of curvature $R_{RCS2}$ which is generally less than the inner radius if curvature $R_{RCS1}$.

Other dimensions of the end member shell 89 in relation to the reformed end member 111 include the diameter $D_{SCP}$ of the shell center panel 12 which is generally greater than a diameter $D_{RCP}$ of the reformed center panel 12. The diameter $D_{SPR}$ of the shell panel radius is substantially equal to the diameter $D_{RPR1}$ of the reformed end member's first panel radius. The diameter $D_{SCS}$ of the shell 89 countersink 16 is generally less than the diameter of a diameter $D_{RCS}$ of the reformed countersink 16. The height $H_{EMS}$ of the end member shell 89 is generally greater than a height $H_{EMR}$ of the reformed end member 111.

The height $H_{EMR}$ of the reformed end member 111 is preferably about 0.235 inches. This allows the radius of curvature $R_{RCW1}$ of the reformed bend to be decreased to improve strength of the reformed end member 111. In order to reform the countersink 16 of the end member shell 89, the end member shell 89 must wrap around the tooling in the conversion press. Thus, the end member shell 89 must have a deeper countersink 16 ($H_{EMS}$ being about 0.0242 inches) and a shallower panel than the reformed end member 111.

However, the deeper countersink 16 of the end member shell 89 causes interference when the end member shells 89 are nested or stacked. The interference occurs at the point where the bend 108 on the chuckwall 15 meets a lower portion of the countersink 16 of an upper stacked end member shell 89. To eliminate the interference, the radius of curvature $R_{SCW1}$ is increased.

In the conversion press, the end member shell 89 is reformed so that the center panel 12 is forced upwardly. The center panel 12 depth is increased from $H_{SCP}$ to $H_{RS1}$. In a subsequent operation, the center panel depth is increased to $H_{RS2}$. The countersink 16 depth is decreased from $H_{EMS}$ to $H_{EMR}$. Thus, the countersink 16 has a shorter length in the reformed end member 111 as compared to the end member shell 89. This process allows the radius of curvature $R_{SCW1}$ of the bend 108 of end member shell 89 to be reformed (decreased) to the radius of curvature $R_{RCW1}$ of the bend 108 of the reformed end member 111 to achieve a better buckle strength.

Figure 4:
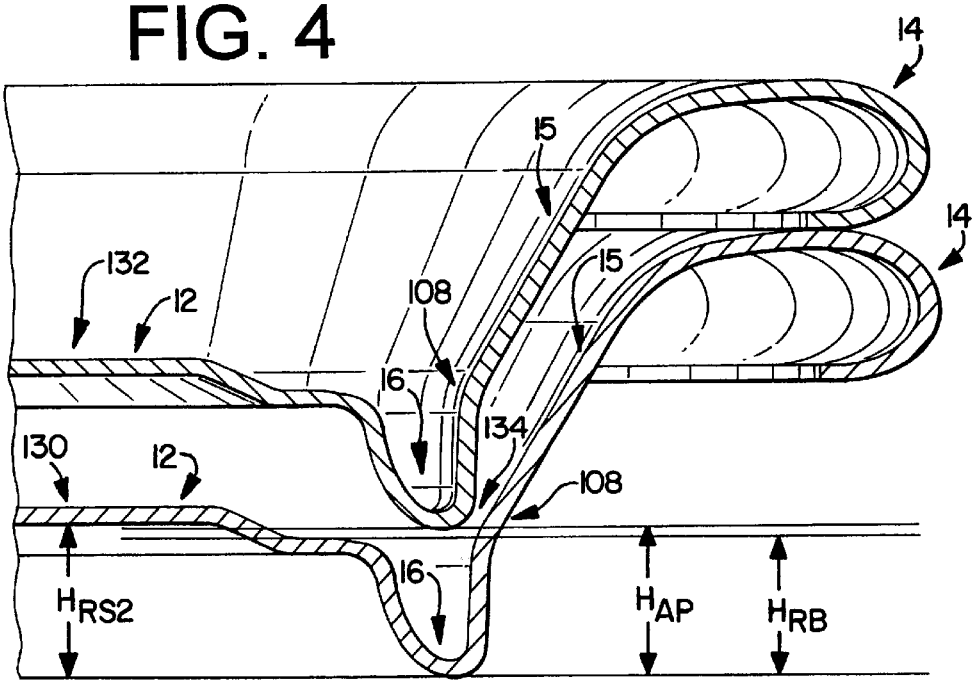
FIG. 4 is a partial cross-sectional view of the two axially stacked reformed end members.

Another advantage of the present method is illustrated in FIG. 4. Namely, the reforming of the first radius of curvature $R_{RCW1}$ displaces the chuckwall 15 outwardly relative to the central axis. This controls axial stacking of a first reformed end member 130 and second reformed end member 132. Proper stacking is important for transportation of the finished end members and subsequent feeding of the end members for attachment onto a filled can body.

During stacking of the reformed end members 130, 132, an approach point 134 defined by the lower outer position of the axially stacked second end member 132, generally the outermost portion of the countersink 16 of the upper stacked end 132, is located radially inwardly of the chuckwall 15. The approach point 134 as illustrated in FIG. 4 is actually located on an annular radial approach segment, which is spaced from the chuckwall 15 of the lower stacked end 130 along its entire annular length.

The method of reforming the chuckwall 15 according to the present invention is adapted to move the chuckwall 15 away from the approach point 134. Stated another way, the reformed radius of curvature $R_{RCW1}$ is adapted to position the chuckwall 15 radially outwardly of the approach point 134. Thus, the end members 130, 132 contact each other along the seaming curl area 14, and there is no interference generated by the remaining portions of the end members 130, 132, and especially no contact of the chuckwall 15 with the outermost lower portions of an axially stacked end member.

The approach point 134 is located on a horizontal plane having a height HAP above the baseline 101. The approach point 134 height $H_{AP}$ is generally above the height $H_{RB}$ of a horizontal plane containing at least a portion of the reformed crease or bend 108.

The end members 130, 132 are stacked such that the seaming curl 14 of the second end member 132 rests upon the seaming curl 130 of the first end member 130. Again, the interference from the chuckwall 15 or other portions of the end members 130, 132 is eliminated during the reforming operation.

While the invention has been described with reference to preferred embodiments, it will be understood by those skilled in the art that various changes may be made and equivalents may be substituted for elements thereof without departing from the broader aspects of the invention. Also, it is intended that broad claims not specifying details of the particular embodiments disclosed herein as the best mode contemplated for carrying out the invention should not be limited to such details.

We claim:

1. A method for strengthening an end member for a container, the end member having a central panel wall with a product side and a public side, the public side having a means for opening a frangible panel segment, the method comprising the steps of:

providing an end member shell comprising a central panel extending radially outwardly from a central axis, a panel radius along a peripheral edge of the central panel, a countersink integral with the panel radius, a chuckwall extending upwardly from the countersink having a bend with a radius of curvature and angled axially outwardly, and a seaming curl defining the outer perimeter of the end member shell and integral with the chuckwall; and reforming the chuckwall to decrease the radius of curvature.

2. The method of claim 1 further comprising the step of reforming the panel radius to form a stepped portion at the peripheral edge of the central panel, the stepped portion having a first arcuate section interconnected to the countersink through a second arcuate section.

3. The method of claim 2 further comprising the step of coining the stepped portion.

4. The method of claim 1 further comprising the step of reforming the countersink wherein the countersink comprises a first portion having a first radius of curvature and a second portion located axially inwardly from the first portion, the second portion having a second radius of curvature.

5. The method of claim 4 wherein the second radius of curvature is greater than the first radius of curvature.

6. The method of claim 1 wherein the end member shell comprises a baseline located at the lower vertical extent of the countersink and the central panel is positioned at a first height above the baseline, and the method further comprises the step of reforming the end member shell to position the central panel at a second height, wherein the second height is greater than the first height.

7. The method of claim 1 wherein the end member shell comprises an approach point defined by the lower outer position of an axially stacked second end member and the method further comprises continuing to reduce the radius of curvature of the bend to a point wherein the chuckwall is positioned radially outwardly of the approach point.

8. The method of claim 7 wherein the approach point is horizontally coplanar with a portion of the bend on the chuckwall.

9. The method of claim 7 wherein the approach point is located above the bend on the chuckwall.

10. The method of claim 7 wherein the approach point is located on a horizontal plane above the first panel radius.

11. The method of claim 7 further comprising the step of reforming the panel radius to form a stepped portion at the peripheral edge of the central panel, the stepped portion having a first arcuate section interconnected to the countersink through a second arcuate section, and the bend located on a horizontal plane between the first arcuate section and the second arcuate section.

12. The method of claim 7 wherein the approach point is coplanar with a portion of the bend on the chuckwall.

13. The method of claim 7 wherein the approach point is located above the bend on the chuckwall.

14. The method of claim 7 further comprising a baseline defined by the lower extent of the countersink, the first panel radius located at a first height above the baseline, the second panel radius located at a second height above the baseline.

15. The method of claim 14 wherein the approach point is located at a third height which is between the first and second heights.

16. The method of claim 14 wherein a portion of the bend is located at the third height.

17. The method of claim 14 wherein a portion of the bend is located below the third height.

18. The method of claim 14 wherein the first height is located at least 0.068 inches above the baseline.

19. The method of claim 17 wherein the second height is located at least 0.086 inches above the baseline.

* * * * *

UNITED STATES PATENT AND TRADEMARK OFFICE

CERTIFICATE OF CORRECTION

PATENT NO. : 6,748,789 B2 
DATED : June 15, 2004
INVENTOR(S) : Timothy Turner, Randy G. Forrest and Rajesh Gopalaswamy It is certified that error appears in the above-identified patent and that said Letters Patent is hereby corrected as shown below:

Column 5,
Line 31, delete "RRCW2" and insert -- $R_{RCW2}$ --.

Signed and Sealed this

Thirtieth Day of August, 2005

JON W. DUDAS
*Director of the United States Patent and Trademark Office*